United States Patent [19]

Roberts

[11] Patent Number: 4,735,252

[45] Date of Patent: Apr. 5, 1988

[54] SYSTEM FOR REFORMING LEVITATED MOLTEN METAL INTO METALLIC FORMS

[75] Inventor: Peter R. Roberts, Groton, Mass.

[73] Assignee: Nuclear Metals, Inc., Concord, Mass.

[21] Appl. No.: 819,376

[22] Filed: Jan. 16, 1986

[51] Int. Cl.[4] ..... B22D 27/02

[52] U.S. Cl. ..... 164/46; 164/423; 164/463; 164/466; 164/502

[58] Field of Search ..... 164/46, 146, 147.1, 164/250.1, 466, 467, 492–495, 498, 500, 502, 503, 505–507, 423, 463; 264/8, 12; 425/7

[56] References Cited

U.S. PATENT DOCUMENTS

| | | | |
|---|---|---|---|
| 3,243,493 | 3/1966 | Bunshah et al. | 164/498 |
| 3,696,858 | 10/1972 | Seulen et al. | 164/500 |
| 4,414,285 | 11/1983 | Lowry et al. | 164/466 |
| 4,544,404 | 10/1985 | Yolton et al. | 264/12 |

FOREIGN PATENT DOCUMENTS

| | | | |
|---|---|---|---|
| 2080715 | 2/1982 | United Kingdom | 164/467 |

OTHER PUBLICATIONS

Brochure of Ajax Magnethermic, "Dynapour Delivers the Metal", May 1977.

*Primary Examiner*—Nicholas P. Godici
*Assistant Examiner*—Richard K. Seidel
*Attorney, Agent, or Firm*—Joseph S. Iandiorio; Douglas E. Denninger

[57] ABSTRACT

An apparatus for manufacturing solidified metallic forms from levitated molten metal including a levitation conduit having an interior surface for accommodating the metal to be levitated, and a device for introducing the metal to the levitation conduit. Induction coils induce a moving magnetic field in the levitation conduit to levitate the metal upwardly through the conduit, and to maintain the outer surface of the levitated metal while molten out of pressured contact with the interior surface of the levitation conduit. The molten metal output is provided to a chamber in which a device reforms the molten metal output and solidifies it.

35 Claims, 8 Drawing Sheets

SYSTEM FOR REFORMING LEVITATED MOLTEN METAL INTO METALLIC FORMS

FIELD OF INVENTION

This invention relates to a method and apparatus which produces desired solid metal forms that are low in impurities and more particularly to such a method and apparatus which re-forms and solidifies levitated molten metal into metallic forms.

BACKGROUND OF INVENTION

Metals low in impurities are desirable for applications where product uniformity, metallurgical homogeneity and high fatigue resistance are required, such as in aerospace applications. Metallic components are often formed and shaped from metallic powders; for example, composite materials can be manufactured by sintering a mixture of metallic powders.

Small, spherical metallic particles are presently produced in the Rotating Electrode Process in which an elongate, high purity rotatable rod or disk is inserted into an atmospherically controlled chamber and confronted with a stationary electrode. The rod serves as the second electrode; an arc struck between the electrodes consumes the rod or disk material as it rotates. The rotation casts off melted material which solidifies into powder. This procedure is costly, however, when it is necessary to accurately machine the rod serving as the electrode; the rod typically rotates at 15,000 rpm and therefore must be extremely uniform in dimension.

Those nickel-based alloys which are commonly referred to as Superalloys present difficulties for the manufacture of pure, uniform powders using the rotating electrode process. The alloys themselves are presently manufactured in batch processes in which appropriate quantities of blocks or bars of each constituent metal are melted and mixed together and are cast into rod form. The resulting rods have typical cast structures with dendrites formed as the alloy solidifies. The dendrites involve short-range variations of chemical composition in the microstructure of the solidified rod and this deviation from homogeneity may be transmitted to powders made from the rod. When dendrites are in the rod serving as the rotating electrode dendrite parts may become present in varying amounts in the molten metal droplets which are spun off by centrifugal force; variations in chemical composition between powder particles ultimately results.

Other processes seek to avoid dendrite formation by working directly with molten metal. In the gas atomization process, a gas of high molecular weight such as argon is directed at a stream of molten metal. Impurities are introduced by contact of the liquid metal with the refractory ceramic linings of crucibles and ladles used to melt and handle the molten metal. Skull melting avoids pick-up of crucible materials but cannot avoid formation and entrainment of dendrite arms and other inhomogeneous particles.

Magnetic levitation is utilized in several processes to transport molten metal. The Dynapour made by Ajax Magnathermic consists of a trough including induction coils which are used to draw liquid metal against gravity over the lip of a crucible and direct the liquid metal into a mold or diecasting machine. Significantly, the liquid metal may come into physical contact with the trough during transport. The contact can cause problems since some metals are more compatible with lining materials than others. For example, liquid copper is compatible with graphite. Titanium, molybdenum, and other metals which form carbides with graphite actively corrode the graphite and therefore are much more difficult to maintain in pure form.

Lowry et al., U.S. Pat. No. 4,414,285, disclose a continuous, contactless metal casting system which raises at a controlled rate molten metal introduced in a liquid state at the lower end of a casting column. A gap is maintained between the molten metal and the inner surface of the column but the gap is minimized to enhance heat transfer between the molten metal and a cooling jacket surrounding the casting column. Significantly, a solid in the form of a continuous rod is removed from the levitation column as the final product. The shape of the form is determined to some extent by the shape of the magnetic field.

The rate at which metals solidify can affect their microcrystalline structure which in turn produces metals having unique properties. Amorphous, ribbon-shaped metals are presently formed by quenching a thin stream of liquid metal against a hollow metal drum chilled by water. The cooling rate required for sufficiently rapid solidification may be as high as $10^8$°C./sec. Contact of the liquid metal with the cooling drum rarely introduces impurities since the solidification is so rapid. However, conventional delivery of the liquid metal to the drum may introduce undesirable impurities to the metal.

SUMMARY OF INVENTION

It is therefore an object of this invention to provide an improved system for manufacturing metallic forms.

It is a further object of this invention to provide an improved system for manufacturing solidified metallic forms from levitated molten metal.

It is a further object of this invention to provide such a system which produces metallic forms low in impurities.

It is a further object of this invention to provide such a system which can produce high-quality powders.

It is a further object of this invention to provide such a system which can produce high-quality ribbons.

A still further object of this invention is to provide such a system which can produce high-quality filaments.

It is a further object of this invention to provide an improved system for fabricating metallic forms which may be composed of a mixture of metals.

Yet another object of this invention is to provide such a system which handles highly corrosive liquid alloys while minimizing introduction of impurities to the alloys.

It is a further object of this invention to provide such a system which can act upon initially solid metals.

This invention results from the realization that extremely pure metallic forms can be achieved by conveying metal upwardly in a levitation conduit, maintaining the metal out of pressured contact with the sides of the conduit, and re-forming the molten metal output of the conduit into the solid metallic forms. When solid metal is introduced into the levitation conduit and the reforming is accomplished by gas atomization or rapid solidification, the metal once molten remains entirely free of impurities.

This invention features an apparatus for manufacturing solidified metallic forms from levitated molten metal. There are a levitation conduit having an interior surface for accommodating the metal to be levitated and means for introducing the metal to the levitation conduit. There are also induction coil means for inducing a moving magnetic field in the levitation conduit to levitate the metal and move it upwardly through the conduit and to maintain the outer surface of the levitated metal while molten out of pressured contact with the interior surface of the levitation conduit. The apparatus further includes a chamber for receiving molten metal output of the levitation conduit and means, disposed in the chamber, for re-forming the molten metal output and solidifying it.

In one embodiment, the means for re-forming includes means for atomizing the molten metal output into a powder. The means for atomizing may include means for directing a stream of gas onto the molten metal output or rotatable means for dispersing the molten metal output. The rotatable means can be a rotatable vessel having a concave face which rotatably contacts the molten metal output.

In another embodiment, the means for re-forming includes means for rapidly cooling by thermal conduction the molten metal output to solidify it into a thin form. The means for rapidly cooling includes a rotatable cooled drum which may have a smooth, continuous contact face which solidifies the molten metal output into a ribbon. The same or similar results may be obtained by impinging molten metal against a cooled continuous belt. Alternatively, the drum has a plurality of grooves disposed circumferentially about its contact face which solidify the molten metal output into a plurality of filaments. The means for rapidly cooling may cool the metal at least at the rate of $10^6$°C./sec.. The moving magnetic field of induction coil means maintains the levitated metal in the molten state in a first cross-sectional dimension and the thin form fabricated by the means for rapidly cooling has a second cross-sectional dimension.

In a preferred embodiment, the chamber is hermetically sealed, has been substantially evacuated of air and backfilled to contain an inert gas. The moving magnetic field of the induction coil means continuously maintains the outer surface of the levitated metal while molten out of contact with the interior surface of the levitation conduit. The interior surface of the levitation conduit may completely surround a cross-sectional dimension of the levitated metal and the means for introducing may include means for providing solid metal to the input end of the levitation conduit. The apparatus may further include means for adjusting the rate of introduction to the metal; the means for adjusting may include means for sensing the exit temperature of the molten metal output. The levitation conduit may be disposed in an inclined position and the apparatus may further include means for altering the inclined position of the levitation conduit. The means for re-forming includes means for directing the diverging gas stream onto the molten metal output.

This invention also features an apparatus for manufacturing solidified metallic forms including a levitation conduit, means for providing solid metal to the input end of the levitation conduit, and induction coil means for inducing a moving magnetic field in the levitation conduit to levitate the metal and move it upwardly through the conduit, and to maintain the outer surface of the levitated metal while molten out of contact with the interior surface of the levitation conduit. This apparatus also includes a chamber and means disposed in the chamber for re-forming the molten metal output and solidifying it. The means for providing solid metal input may simultaneously provide a plurality of solid metals to the levitation conduit.

This invention further features an apparatus including a levitation conduit, means for providing to the input end of the levitation conduit a plurality of solid metals in a ratio selected to produce an alloy, and induction coil means which levitates the metal, maintains the outer surface of the levitated metal while molten out of contact with the interior surface of the levitation conduit, and accomplishes mixing of the metals to provide a homogeneous molten alloy. There is also means for solidifying the molten alloy. The ratio of metals provided to the input end of the conduit may remain substantially constant during manufacture of the alloy.

This invention also features a method of manufacturing solidified metallic forms from levitated molten metal including introducing metal to a levitation conduit, inducing a moving magnetic field in the levitation conduit to levitate the metal and move it upwardly through the conduit, and to maintain the outer surface of the levitated metal out of pressured contact with the interior surface of the levitation conduit. The method further includes receiving molten metal output of the levitation conduit and re-forming and solidifying the molten metal output.

The fashioning and solidifying can include atomizing the molten metal output into a powder such as by using diverging jets of gas, or can include rapidly cooling by thermal conduction the molten metal output to solidify it into a thin form. The method may include introducing solid metal into the levitation conduit.

In another method according to this invention, a plurality of solid metals is introduced into the levitation conduit wherein the metals are in a ratio selected to produce a predetermined alloy. The method further includes inducing a moving magnetic field in the levitation conduit to levitate the metal and move it upwardly through the conduit, to maintain the outer surface of the levitated metal while molten out of contact with the interior surface of the levitation conduit, and to accomplish mixing of the metals to provide a molten alloy. The method further includes solidifying the molten alloy.

DISCLOSURE OF PREFERRED EMBODIMENTS

Other objects, features and advantages will occur from the following description of preferred embodiments and the accompanying drawings, in which.

This invention may be accomplished by an apparatus which conveys metal upwardly in a levitation conduit, heats the metal to a temperature above its melting point, and re-forms the molten metal output of the conduit into solid metallic forms. The metal while molten is maintained out of pressured contact with the interior surface of the levitation conduit. Preferably, the metal while molten is maintained continually out of contact with the interior of the levitation conduit.

The metal is atomized into a powder or rapidly solidified into a ribbon or filaments. The resulting metallic forms differ in at least one cross-sectional dimension from the cross-sectional dimension of the metal in the levitation conduit. For example, the levitated metal is circular in cross-section and has a diameter of x while the molten metal output is rapidly quenched into a ribbon having a width of approximately x but a thickness of y or into a filament having a diameter of z where both y and z are substantially smaller than x.

Gas atomization and rapid solidification serve to reform the molten metal without introducing impurities into the molten metal. The metal can be introduced in a molten state or, to prevent the metal from entraining impurities in a molten state before it enters the levitation conduit, metal can be introduced in solid form to the input end of the conduit. The induced magnetic field levitates the metal and also raises the temperature of the metal above its melting point. Coupled with gas atomization or rapid solidification of molten metal emerging from the conduit, the metal remains entirely free of impurities.

The levitation conduit can be a vertical column such as that disclosed in Lowry et al., U.S. Pat. No. 4,414,285, hereinafter referred to as Patent '285 and which is incorporated herein by reference, or can be an inclined levitation conduit. In contrast to the shape of the metal that is carefully controlled by the pressure head on the molten metal and the rate of extraction of solidified rod in the process described in Patent '285, the shape of the molten metal within a levitation conduit in a manufacturing apparatus or method according to this invention is not critical to this invention, as will become apparent.

Further, the levitation conduit utilized by a method and apparatus according to this invention does not require a heat exchanger or other device for cooling the levitated metal. While one utilizing the process of Patent '285 must be concerned with the inverse relationship between levitation field strength and heat removal rate to prevent unacceptable variations in emerging rod temperature, that concern is not present here.

Figure 1:
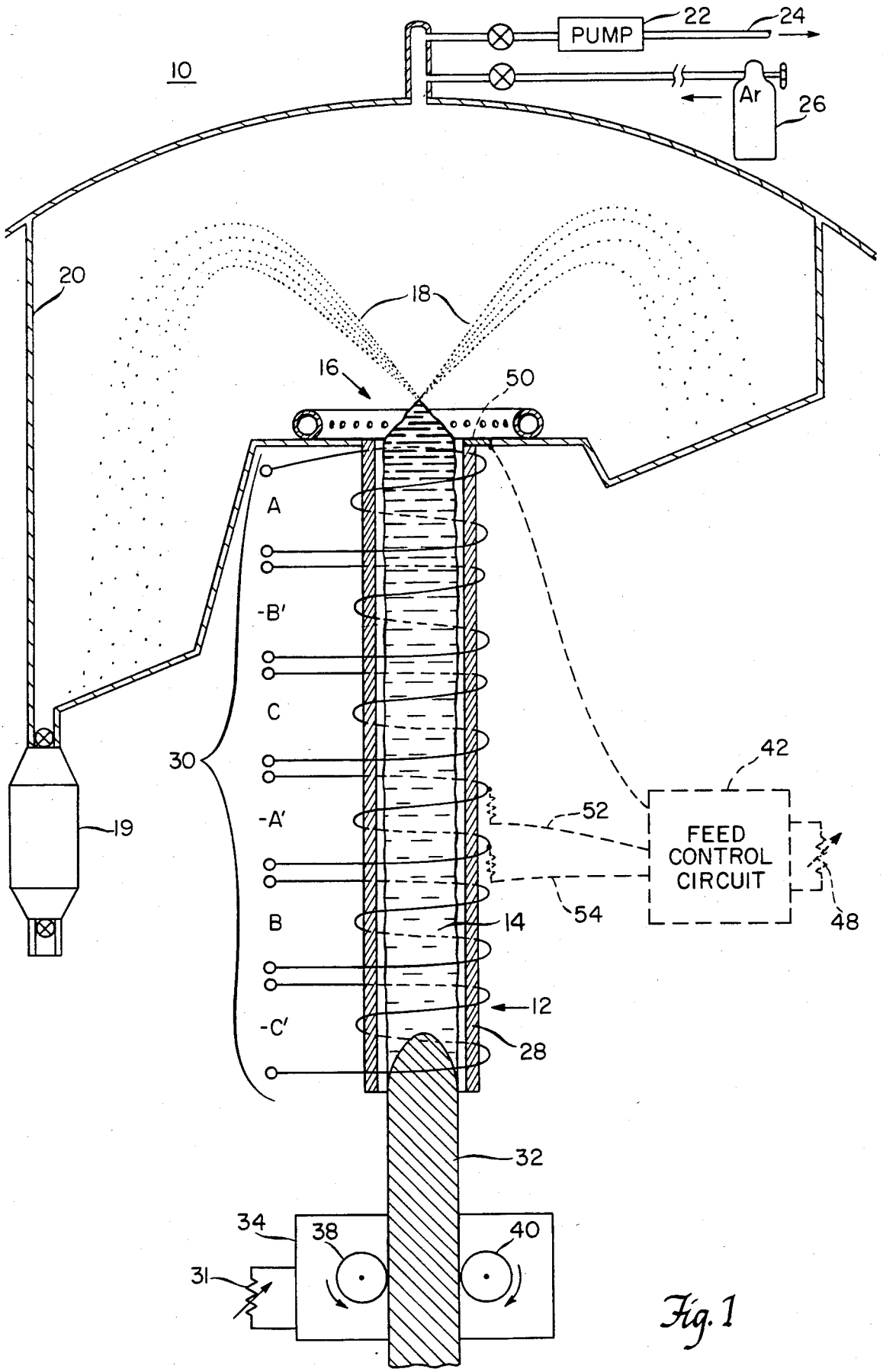
FIG. 1 is a schematic cross-sectional view of a levitation conduit, a gas atomization work station for re-forming into a powder the molten metal output of the levitation conduit and a chamber for receiving the powder.

Manufacturing apparatus 10, FIG. 1, includes levitation conduit 12 which levitates molten metal 14 upwardly to gas atomization work station 16 which reforms molten metal 14 into particles 18. Solidified particles are collected in hopper 19. Work station 16 is located within chamber 20 from which air is evacuated by pump 22 through outlet 24 and then backfilled to several psi above atmospheric pressure with an inert gas such as argon in canister 26. It is desirable for pump 22 to evacuate chamber 20 to a pressure of $10^{-6}$ mm Hg before backfilling to ensure that little or no oxygen is present to combine with the molten metal.

Levitation conduit 12 includes graphite liner 28. Coil set 30 surrounds graphite liner 28 and induces the magnetic levitation force when six phases are successively shifted 60° apart to provide a smooth field-transporting action. The six phases are represented powering the coils in the order −C′, B, −A′, C, −B′, A ascending the column. As described in Patent '285, columns 6 through 7, two sets 30 provide 12 coils in an overall levitation section of 6 inches. Unlike the levitation column described in Patent '285, a cooling jacket is not required since the objective of manufacturing apparatus 10 is to raise the temperature of the levitated metal to a temperature at or above its melting point. It is desirable for the magnetic field to induce a superheat, e.g., as much as 200°C. above the liquidus temperature of the metal.

Another distinction from Patent '285 is that a manufacturing apparatus according to this invention need not control the shape of molten metal 14 within levitation conduit 12. The rate at which molten metal is provided to work station 16 is adjusted by varying the polyphase high-frequency power applied to coils 30 or by varying, utilizing potentiometer 31, the rate at which solid metal bar 32 is fed into levitation conduit 12 by feed motor 34. For example, potentiometer 31 is varied by an operator to increase feed rate until the operator observes that molten metal 14 enters work station 16 at a desired rate and at a desired level of superheat measured by pyrometer 50.

In a semi-automated construction, the rate at which rollers 38, 40 feed solid metal 32 is controlled by feed control circuit 42, shown in phantom. The feed rate can be manually set using potentiometer 48; alternatively, feed control circuit 42 monitors the temperature of molten metal provided to work station 16 using pyrometer 50 to maintain a desired level of superheat. Since solid metal exhibits a different resistivity than molten metal, control circuit 42 can also monitor the electrical coupling between metal 14 and the coils 30 such as by lines 52, 54.

Figure 2B:
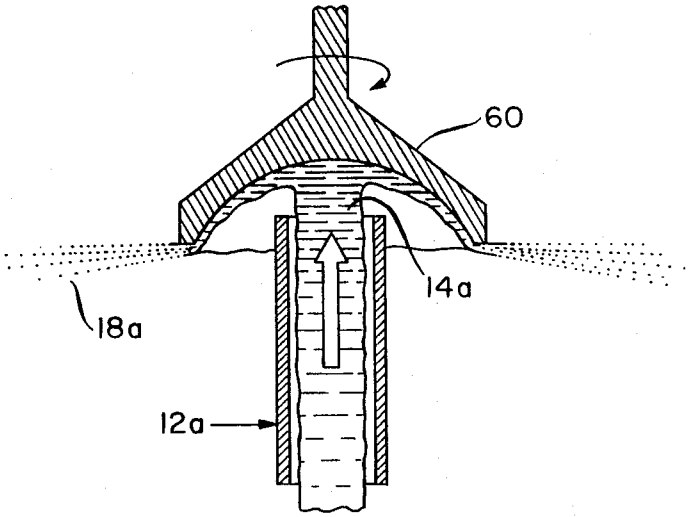
FIG. 2B is an elevational cross-sectional view of the work station of FIG. 2A.
Figure 2A:
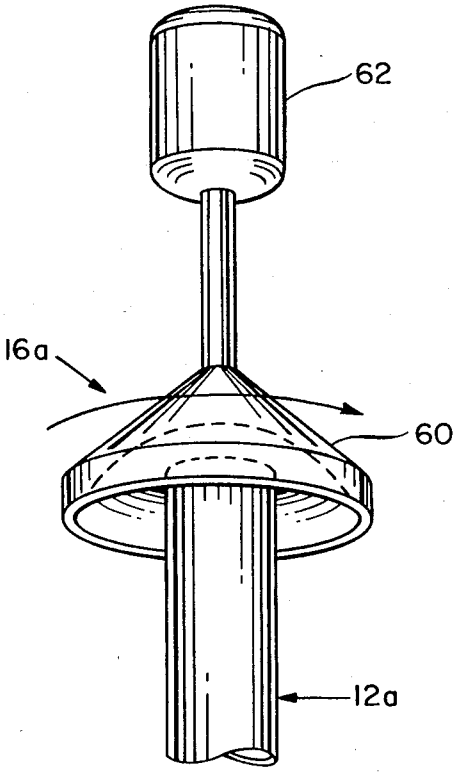
FIG. 2A is an axonometric view of an alternative work station including a rotatable vessel.

An alternative work station **16*a* for producing powders is shown in FIG. 2A. Vessel 60 is rotated at a speed of 20,000 to 40,000 rpm by motor 62. Molten metal provided by levitation conduit 12*a* strikes the concave inner surface of inverted vessel 60** and is spun off as a powder.

Molten metal **14*a* is shown striking the inner surface of vessel 60 in FIG. 2B. It is desirable that the inner surface of vessel 60 consist of a material which is not corrodable by molten metal 14*a***, e.g., graphite for reforming liquid copper or aluminum, or cast iron for aluminum-iron alloys.

Figure 3A:
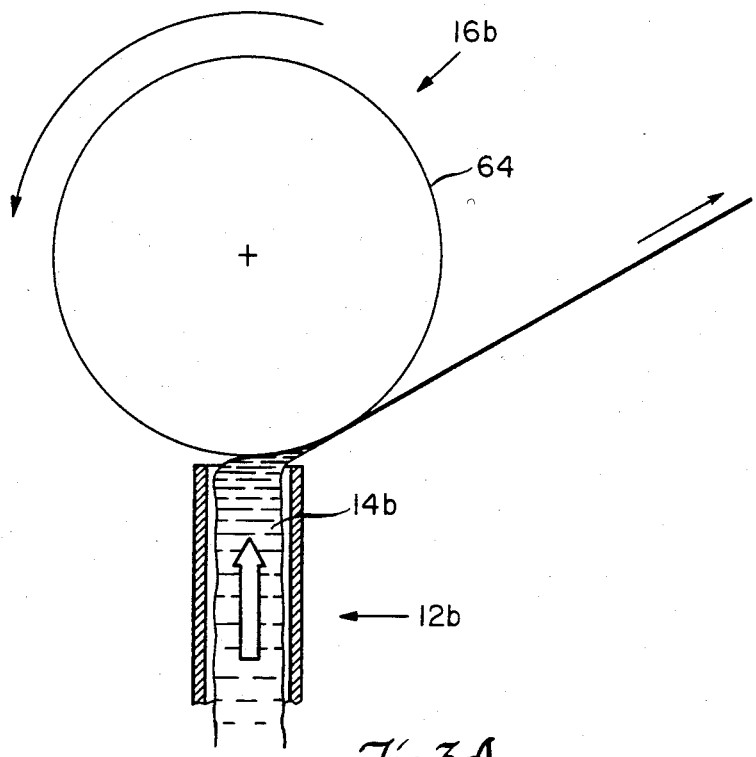
FIG. 3A is an alternative work station showing rapid quenching of molten metal output of the levitation conduit into a thin ribbon by contact with a rapidly rotating chilled wheel.

A manufacturing apparatus according to this invention is not limited to the formation of powders. Molten metal 14*b*, FIG. 3A, impinges upon chilled, rotating drum 64 of work station 16*b* to form a rapidly solidified ribbon. The metal, or melt, is chilled to a solid and spun away in a continuous formation operation. Acceptable dimensions of the ribbons are 5–25 microns thickness and 1–6 inches width although these dimensions need not be limited to these ranges. Drum 64, a quenching wheel, rotates at several thousand rpm and is maintained below 100° C. at its surface by a internally circulated coolant such as water. Cooling of the melt occurs by conduction at a rate which may be as high as $10^8$ °K./sec.

Figure 3B:
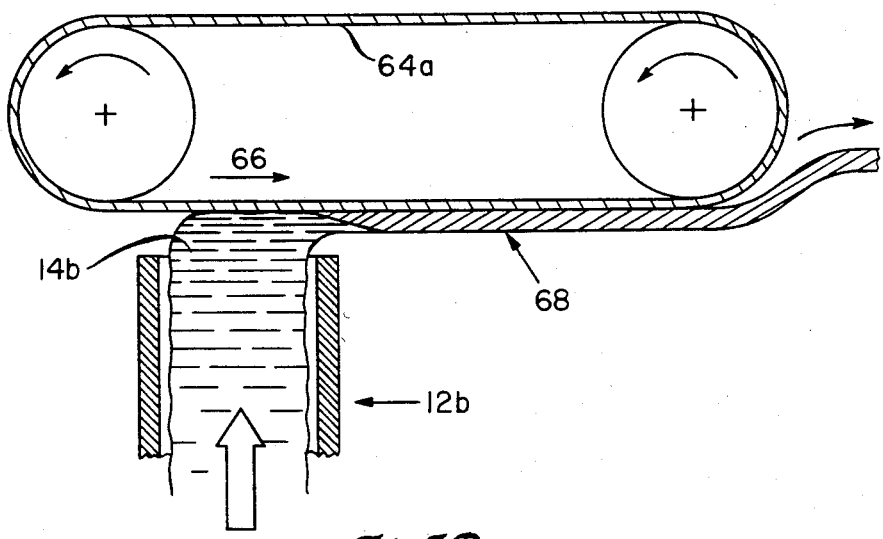
FIG. 3B is another work station for quenching the molten metal by contact with a continuously presented chilled surface such as a continuous belt.

The interaction of the melt with the surface of cooled belt 64*a* is shown in more detail in FIG. 3B. Melt 14*b* emerges from evitation conduit 12*b* to impinge upon the surface of belt 64*a* and is swept in the direction of travel indicated by arrow 66. The portion the molten film of metal closest to belt 64*a* solidifies first, quickly followed by the remainder of the film to form solid ribbon 68.

Figure 4A:
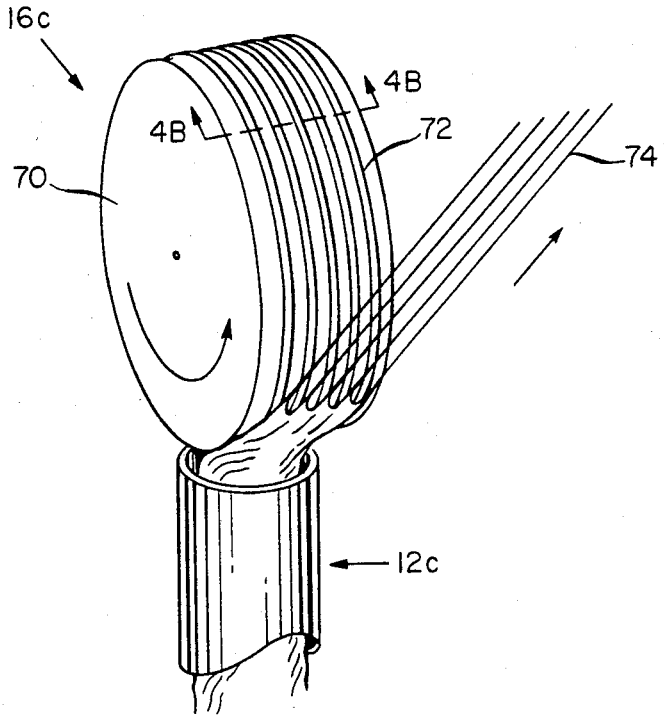
FIG. 4A is a schematic axonometric view of filament formation on a cooling drum with shallow cooling fins.
Figure 4B:
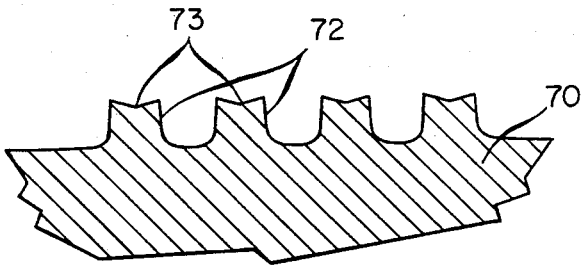
FIG. 4B is a more detailed view of the cooling fins on the drum along line 4B—4B of FIG. 4A.

A number of different cooling arrangements are possible. Drum 64 can have a smooth surface to produce a smooth, flat ribbon; alternatively, surface of drum 64 is patterned to provide a metal which is more easily broken into fragments if needed in a pulverized form. Rapidly solidified filaments are produced by work station 16*c*, FIG. 4A. Rotatable drum 70 receives molten metal onto shallow fins 72 from work station 12*c* and produces filaments 74. Fins 72, shown in an enlarged view in FIG. 4B, are continuous about drum 70 and produce filaments having a cross section of approximately 25 microns in diameter. The melt quenches within shallow grooves 73. In another construction, the fins are provided with transverse channels to produc staple length filaments.

Figure 5:
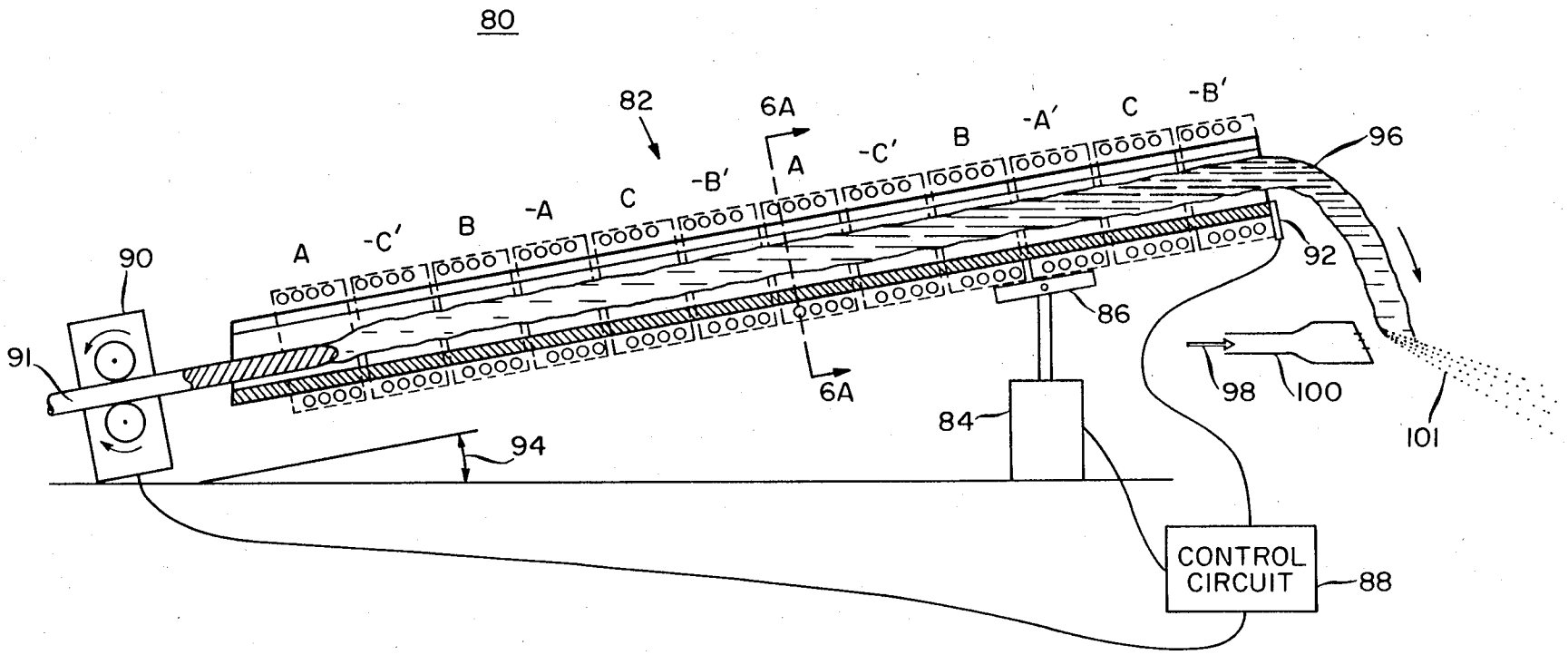
FIG. 5 is a schematic cross-sectional view of an alternative levitation conduit providing molten metal to a side atomization work station.

Manufacturing apparatus 80, FIG. 5, includes inclined levitation conduit 82 supported by hydraulic lift 84 having pivoting platform 86. Control circuit 88 monitors the input rate of solid rod 91 imparted by feed apparatus 90 and the output temperature of melt 96 using pyrometer 92 and commands lift 84 to adjust the angle of incline, arrow 94, to maintain the desired rate of exit of melt 96. Inert gas 98 emerging through atomizing device 100 produces particles 101.

Figure 8:
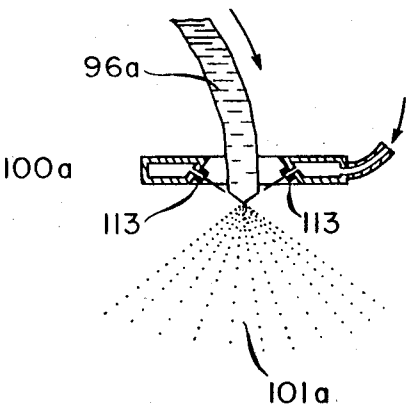
FIG. 8 is a schematic elevational cross-sectional view of an alternative jet ring atomization device for the work station of FIG. 5.

Typically, the induced heating, such as illustrated in FIG. 8 of Patent '285 resulting from a power level sufficient to levitate the molten metal, is sufficient to melt solid metal fed into the levitation conduit and to heat the metal to a temperature well above its melting point. If additional heating is desired the power level can be increased.

When using a levitation conduit similar to the levitation column of Patent '285, atomization must commence before the lifting force diminishes below the level required to keep the melt moving upward. Using an inclined conduit, however, atomization can be performed on a descending stream of molten metal which can be more finely controlled by adjusting polyphase power input, frequency, conduit incline, or a combination of these parameters.

Figure 6B:
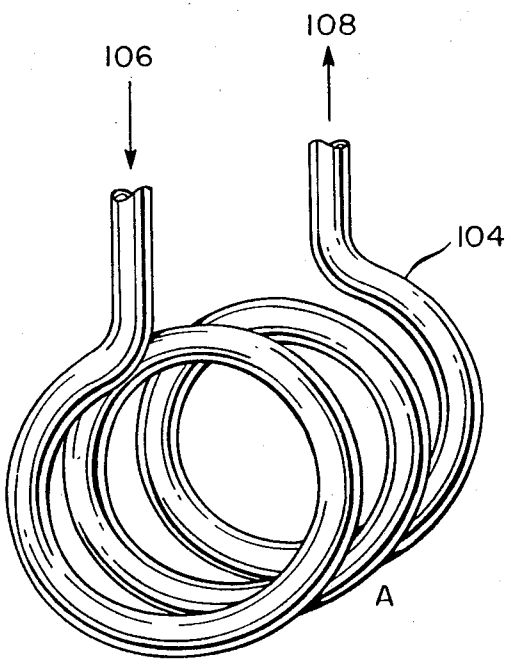
FIG. 6B is an axonometric view of a water-cooled power coil carrying one electrical phase for the levitation conduit of FIG. 5.
Figure 6A:
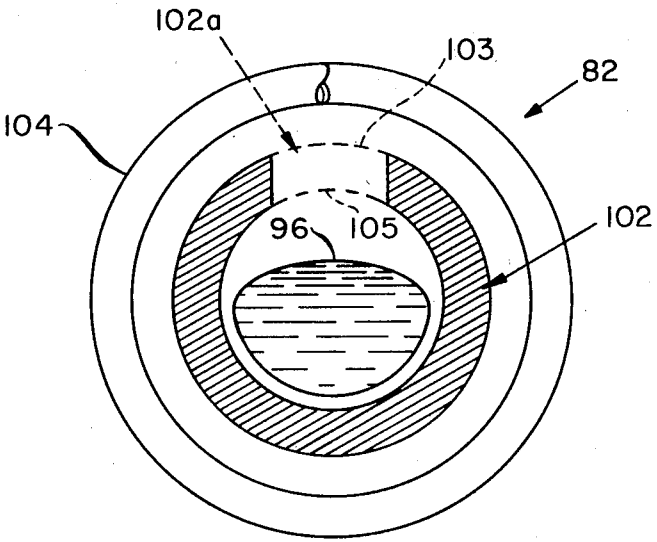
FIG. 6A is a cross-sectional view along line 6A—6A of the levitation conduit of FIG. 5.

Levitation conduit 82 is shown in cross-section in FIG. 6A to reveal melt 96, liner 102, and water cooled coil 104. Liner 102 is heavy walled graphite; alternatively, water cooled copper can be used.

Coil 104 carries the power and is water-cooled to prevent it from melting. While liner 102 is shown in a horseshoe shape, it may more completely envelop the molten meal as illustrated by liner 102*a*. Liner 102*a* may completely surround melt 96 as indicated by dashed lines 103, 105 extending from the edges of liner 102.

Coil 104 for coil section A is shown in an axonometric view in FIG. 6B where water is provided as indicated by arrow 106 and exits as indicated by arrow 108.

Figure 7A:
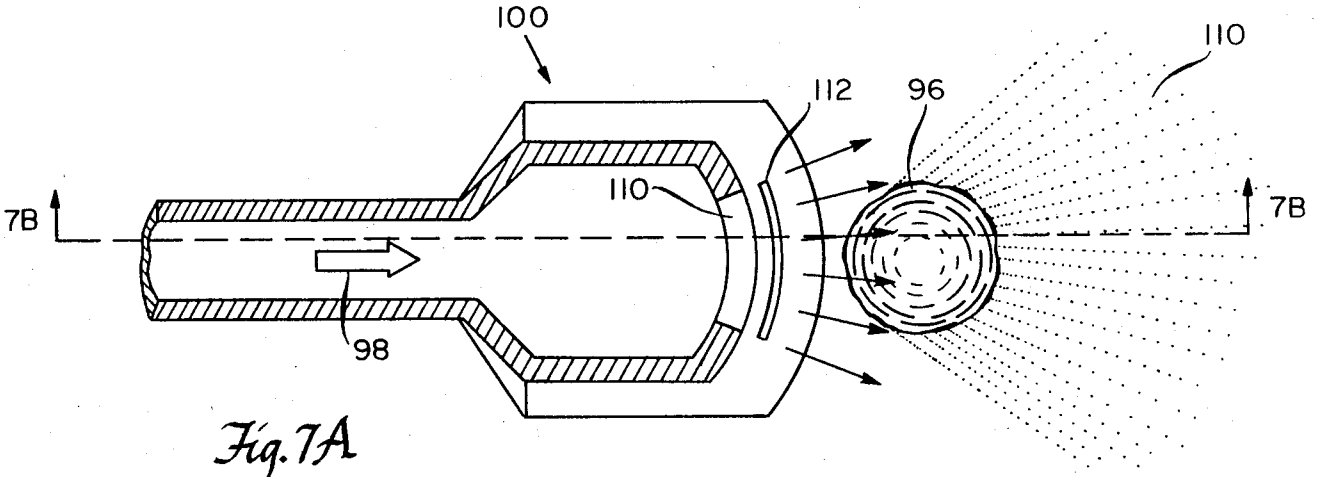
FIG. 7A is a top plan view with partial cutaway of the work station of FIG. 5.
Figure 7B:
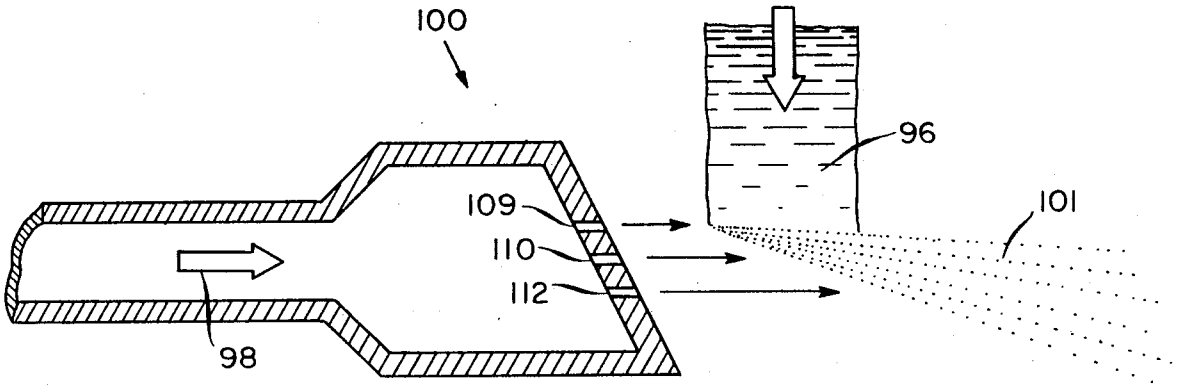
FIG. 7B is an elevational cross-sectional view along line 7B—7B of the work station of FIG. 7A.

Atomizing device 100 is shown in partial cross section viewed from the top in FIG. 7A and from the side in FIG. 7B. Argon or any other, desired gas 98 passes through fan-shaped jets 109, 110 and 112 to disperse molten metal 96 into particles 101. Jet dimensions in relationship to the diameter of the metal stream are chosen for optimum performance as is known to those skilled in the art.

Atomizing device 100 produces a diverging pattern of powder. Conventional gas aomized powder suffers from "satellites": the converging gas jets cause some particles to collide and agglomerate in groups before their surfaces have cooled sufficiently. This clumping alters the desired particle size distribution obtained. If desired, however, a conventional atomizer such as ring atomizing device 100*a*, FIG. 8, can be used to fragment or otherwise re-form melt 96*a*. Converging streams of argon emerging from 0.02 to 0.05 inch diameter jets 113 impinge upon molten stream 96*a* to produce powder 101*a*.

While the metal provided to the input end of the levitation conduit is described above in terms of a solid rod or bar, this is not a limitation of the invention. A number of solid metals can be provided continually in a ratio selected to produce an alloy by melting and mixing the metals within a levitation conduit. Homogeneity is assured by arranging the parameters of the levitation conduit such that the metals liquefy a predetermined distance from the exit of the conduit. Levitation is provided by the induction coils which also induce mixing and stirring of the metals.

Figure 9:
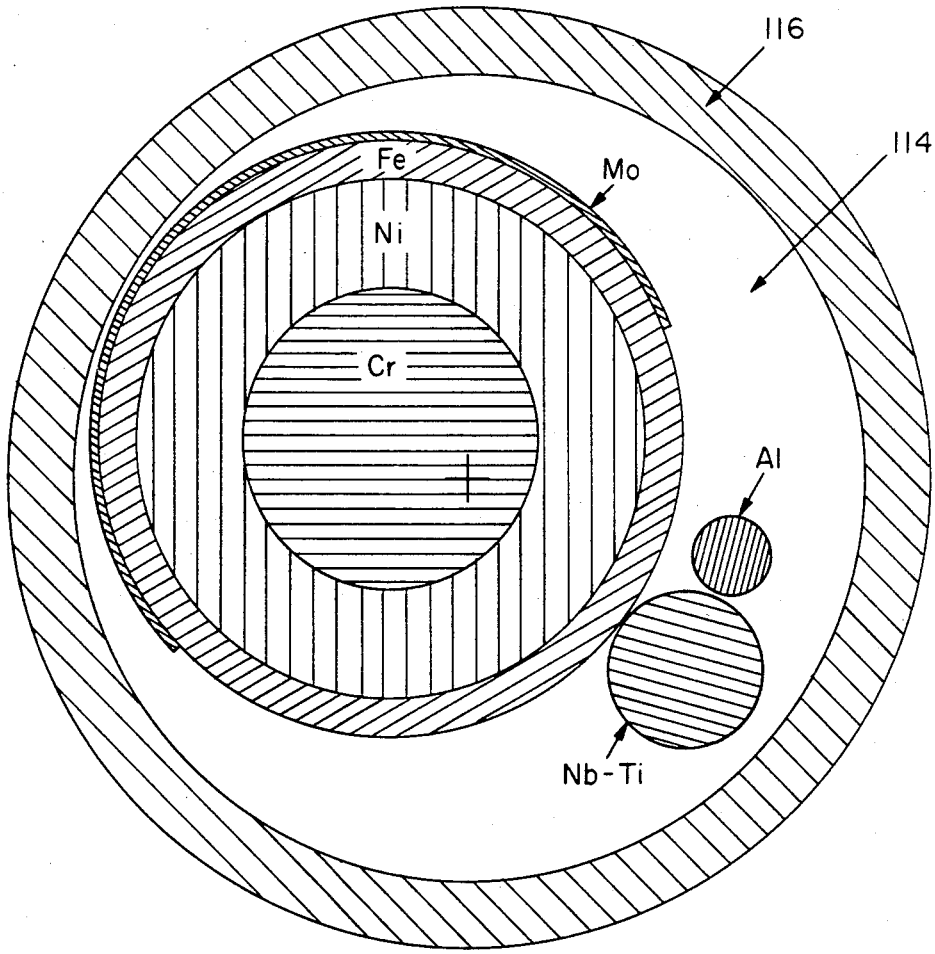
FIG. 9 is a top cross-sectional view of a plurality of solid metals to be introduced into the levitation conduit of FIG. 1 or FIG. 5 to form IN-718 alloy.

The constituent metals 114 of IN-718 alloy are shown in FIG. 9 in cross section within graphite liner 116. To obtain a pure alloy, metals 114 are of high purity and contain almost no non-metallic inclusions. Chromium rod Cr, obtained in a pure state by the Van Arkel iodide process, for example, is surrounded with nickel Ni coating that is electroplated over rod Cr. Iron Fe is then electroplated or provided as a carbonyl coating over the nickel coating Ni. Molybdenum Mo is then wrapped as a foil over the iron Fe. The two other major ingredients, aluminum Al and niobium-titanium Nb-Ti are provided as separate wires. The composition by weight percent, density, cross section and dimension of these constituents for liner 116 having a 1-inch bore is shown in Table I. Carbon C, manganese Mn, silicon Si and copper Cu can be added as a spray or may be alloyed to wire Al. The Nb-Ti wire is assumed to be 85 Nb 15 Ti wire having a density of approximately 8 g/cc. Sixty-five percent of the 1-inch bore or 0.5105 square inch is occupied by the wire and rod composition 114.

TABLE I

| ELEMENT | COMPOSITION w/o | DENSITY ρ (g/cc) | NORMALIZED CROSS-SECTION (w/o/ρ) | CROSS-SECTION % | WIRE OR ROD DIMENSION* (INCH) | SOURCE |
|---|---|---|---|---|---|---|
| CROSS-SECTION OF PURE WIRES & RODS TO FORM IN-718 | | | | | | |
| Ni | 52.5 | 8.9 | 5.899 | 48.63 | 0.676 × 0.376 | Electroplate Over Cr Bar |
| Cr | 19.0 | 7.2 | 2.639 | 21.76 | 0.376Ø | Van Arkel Pure Bar |
| Fe | 18.5 | 7.86 | 2.354 | 19.41 | 0.764 × 0.676 | Electroplate Over Ni Layer |
| Nb | 5.13 | 8.57 8 | 0.754 | 6.22 | 0.201Ø | Cold Hearth Melted 85Nb—15Ti Alloy Drawn to Wire |
| Ti | 0.9 | 4.5 | | | | |
| Mo | 3.05 | 10.2 | 0.299 | 2.46 | 0.126Ø or 0.010 Foil | Wire or Foil |
| Al | 0.5 | 2.7 | 0. ± 85 | 1.53 | 0.100Ø or 0.005 Foil | Wire or Foil |
| C, Mn Si, Cu | 0.55 Total | — | — | — | — | Alloy Additions to Al Wire Foil |

To produce a highly uniform alloy, it is desirable for the volume fraction or weight percentage of each constituent to remain constant as it is introduced into a levitation conduit. Preferably the metals are introduced as a rigid bundle of wire and rod.

Although specific features of the invention are shown in some drawings and not others, this is for convenience only as each feature may be combined with any or all of the other features in accordance with the invention.

Other embodiments will occur to those skilled in the art and are within the following claims.

What is claimed is:

1. An apparatus for manufacturing solidified metallic forms from levitated molten metal comprising:

a levitation conduit having an interior surface for accommodating metal to be levitated;

means for introducing the metal to said levitation conduit;

induction coil means for inducing a moving magnetic field in said levitation conduit to levitate the metal and move it upwardly through said conduit, and to maintain the outer surface of the levitated metal while molten out of pressured contact with said interior surface of said levitation conduit;

a chamber for receiving molten metal output of said levitation conduit; and means, disposed in said chamber, for reforming and solidifying the molten metal output into a different shape to define the solidifidied metallic forms.

2. The apparatus of claim 1 in which said means for re-forming includes means for atomizing the molten metal output into a powder.

3. The apparatus of claim 1 in which said means for re-forming includes means for rapidly cooling by thermal conduction the molten metal output to solidify it into a thin form.

4. The apparatus of claim 1 in which the moving magnetic field of said induction coil means continuously maintains the outer surface of the levitated metal out of contact with the interior surface of said levitation conduit.

5. The apparatus of claim 1 in which the interior surface of said levitation conduit completely surrounds the cross-sectional dimension of the levitated metal.

6. The apparatus of claim 1 in which said means for introducting includes means for providing solid metal to the input end of said levitation conduit.

7. The apparatus of claim 1 further including means for adjusting the rate of introduction of the metal.

8. The apparatus of claim 7 in which said means for adjusting includes means for sensing the exit temperature of said molten metal output.

9. An apparatus for manufacturing solidified metallic froms from levitated molten metal comprising:

a levitation conduit having an interior surface for accommodating metal to be levitated;

means for introducing metal to said levitation conduit;

induction coil means for inducing a moving magnetic field in said levitation conduit to levitate the metal and move it upwardly through said conduit, and to maintain the outer surface of the levitated metal while molten out of pressured contact with said interior surface of said levitation conduit;

a chamber for receiving molten metal output of said levitation conduit; and means, disposed in said chamber, for atomizing the molten metal output into a powder.

10. The apparatus of claim 9 in which said means for atomizing includes means for directing a stream of gas onto the molten metal output.

11. The apparatus of claim 9 in which said means for atomizing includes rotatable means for dispersing the molten metal output.

12. The apparatus of claim 11 in which said means for dispersing is a rotatable vessel having a concave face which rotatably contacts the molten metal output.

13. An apparatus for manufacturing solidified metallic forms from levitated molten metal comprising:

a levitation conduit having an interior surface for accommodating metal to be levitated;

means for introducing metal to said levitation conduit;

induction coil means for inducing a mvoing magnetic field in said levitation conduit to levitate the metal and move it upwardly through said conduit, and to maintain the outer surface of the levitated metal while molten out of contact with said interior surface of said levitation conduit, said induction coil means maintaining the levitated metal in the molten state in a first cross-sectional dimension;

a chamber for receiving molten metal output of said levitation conduit; and means, disposed in said chamber, for rapidly cooling by conduction the molten metal output to solidify it into a thin form which has a second cross-sectional dimension.

14. The apparatus of claim 13 in which said means for rapidly cooling includes a rotatable cooled drum.

15. The apparatus of claim 14 in which said drum has a smooth, continuous contact face which solidifies the molten metal output into a ribbon.

16. The apparatus fo claim 14 in which said drum has a plurality of grooves disposed circumferentially about its contact face which solidify the molten metal output into a plurality of filaments.

17. The apparatus of claim 13 in which said means for rapidly cooling includes a cooled continuous belt.

18. The apparatus of claim 13 in which said means for rapidly cooling cools the metal at least at the rate of $10^6$°C./sec..

19. The apparatus of claim 13 in which the moving magnetic field of siad induction coil means maintains levitated metal in the molten state in a first cross-sectional dimension and the thin form fabricated by said means for rapidly cooling has a second cross-sectional dimension.

20. An apparatus for manufacturing solidified metallic forms from levitated molten metal comprising:

a levitation conduit;

means for providing solid metal to the input end of said levitation conduit;

induction coil means for inducing a moving magnetic field in said levitation conduit to levitate the metal and move it upwardly through said conduit, and to maintain the outer surface of the levitated metal while molten out of contact with said interior surface of said levitation conduit;

a chamber for receiving molten metal output of said levitation conduit; and means disposed in said chamber, for re-forming the molten metal output and solidifying it.

21. The apparatus of claim 20 in which said means for providing simultaneously provides a plurality of solid metals to said levitation conduit.

22. An apparatus for manufactuiring an alloy low in impurities, comprising;

a levitation conduit;

means for providing to the input end of said levitation conduit a plurality of solid metals in a ratio selected to produce an alloy;

induction coil means for inducing a moving magnetic field in said levitation conduit to levitate the metal and move it upwardly through said conduit, to maintain the outer surface of the levitated metal while molten out of contact with said interior surface of said levitation conduit, and to accomplish mixing of the metals to provide a molten alloy; and means for solidifying the molten alloy.

23. The apparatus of claim 22 in which the ratio of metals provided to the input end of said levitation conduit remains substantially constant during manufacture of the alloy.

24. A method of manufacturing solidified metallic forms from levitated molten metal comprising:

introducing metal to a levitation conduit;

inducing a moving magnetic field in the levitation conduit to levitate the metal and move it upwardly through the conduit, and to maintain the outer surface of the levitated metal while molten out of pressured contact with the interior surface of the levitation conduit;

receiving molten metal output of the levitation conduit; and re-forming and solidifying the molten metal output into a different shape to define the solidified metallic forms.

25. The method fo claim 24 in which solid metal is introduced into the levitation conduit.

26. A method of producing an alloy of metals in a levitation column comprising;

introducing a plurality of solid metals into a levitation conduit wherein the metals are in a ratio selected to produce a predetermined alloy;

inducing a moving magnetic field in the levitation conduit to levitate the metal and move it upwardly through the conduit, to maintain the outer surface of the levitated metal while molten out of contact with the interior surface of the levitation conduit, and to accomplish mixing of the metals to provide a molten alloy; and solidifying the molten alloy.

27. An apparatus for manufacturing solidified metallic forms from levitated molten metal comprising:

a levitation conduit disposed in an inclined position and having an interior surface for accommondating metal to be levitated;

means for introducing the metal to said levitation conduit;

induction coil means for inducing a moving magnetic field in said levitation conduit to levitate the metal and move it upwardly through said conduit, and to maintain the outer surface of the levitated metal while molten out of pressured contact with said interior surface of said levitation conduit;

a chamber for receiving molten metal output of said levitation conduit; and means, disposed in said chamber, for re-forming and solidifying the molten metal output into a different shape.

28. The apparatus of claim 27 further including means for altering the inclined position of said levitation conduit.

29. The apparatus of claim 28 in which said means for re-forming includes means for directing a diverging stream of gas onto the molten metal output.

30. An apparatus for manufacturing solidified metallic forms from levitated molten metal comprising:

a levitation conduit having an interior surface for accommodating metal to be levitated;

means for introducing the metal to said levitation conduit;

induction coil means for inducing a moving magnetic field in said levitation conduit to levitate the metal and move it upwardly through said conduit, and to maintain the outer surface of the levitated metal while molten out of pressured contact with said interior surface of said levitation conduit;

a hermetically sealed chamber for receiving molten metal output of said levitation conduit; and means, disposed in said chamber, for reforming and solidifying the molten metal output into a different shape.

31. The apparatus of claim 30 in which said chamber is substantially evacuated of air.

32. The apparatus of claim 31 in which said chamber contains an inert gas.

33. A method of manufacturing solidified metallic forms from levitated molten metal comprising:

introducing metal to a levitation conduit;

inducing a moving magnetic field in the levitation conduit to levitate the metal and move it upwardly through the conduit, and to maintain the outer surface of the levitated metal while molten out of pressured contact with the interior surface of the levitation conduit;

receiving molten metal output of the levitation conduit; and re-forming and solidifying the molten metal output, including atomizing the molten metal output into a powder.

34. The method of claim 33 in which the molten metal output is atomized using diverging jets of gas.

35. A method of manufacturing solidified metallic forms from levitated molten metal comprising:

introducing metal to a levitation conduit;

inducing a moving magnetic field in the levitation conduit to levitate the metal and move it upwardly throught the conduit, and to maintain the outer surface of the levitated metal while molten out of pressured contact with the interior surface of the levitation conduit;

receiving molten metal output of the levitation conduit; and re-forming and solidifying the molten metal output, including rapidly cooling by conduction the molten metal output to solidify it into a thin form.

* * * * *